United States Patent [19]

Kaimo

[11] Patent Number: 4,865,504

[45] Date of Patent: Sep. 12, 1989

[54] DEVICE FOR JOINING TOGETHER BUILDING UNITS

[75] Inventor: Matti O. Kaimo, Virkkala, Finland

[73] Assignee: Oy Lohja AB, Nummela, Finland

[21] Appl. No.: 111,267

[22] Filed: Oct. 22, 1987

[30] Foreign Application Priority Data

Oct. 27, 1986 [FI] Finland ..... 864336

[51] Int. Cl.[4] ..... F16B 19/00; F16C 11/06; F16D 1/12

[52] U.S. Cl. ..... 411/361; 411/522; 403/155; 403/377; 52/726

[58] Field of Search ..... 411/320, 363–365, 411/360–362, 353, 447, 513, 515, 517, 541, 540, 522; 403/155, 324, 326, 371, 377; 29/438–440, 509, 515; 52/726

[56] References Cited

U.S. PATENT DOCUMENTS

| | | | |
|---|---|---|---|
| 1,395,526 | 11/1921 | Schafer | 411/361 |
| 1,819,380 | 8/1931 | Osborne | 411/513 |
| 1,873,245 | 8/1932 | Abegg | 403/377 |
| 2,219,591 | 10/1940 | Hiester | 29/439 |
| 2,558,704 | 6/1951 | Heimann et al. | 411/517 |
| 3,884,589 | 5/1975 | Liedholm | 411/353 |

FOREIGN PATENT DOCUMENTS

| | | |
|---|---|---|
| 59839 | 8/1973 | Finland . |
| 57293 | 3/1980 | Finland . |
| 58669 | 11/1980 | Finland . |

*Primary Examiner*—Neill R. Wilson

*Attorney, Agent, or Firm*—Finnegan, Henderson, Farabow, Garrett & Dunner

[57] ABSTRACT

The present invention relates to a device for joining together building units, comprising a lock housing (2) positioned in one building unit; a peg (3) provided in the other building unit so as to be inserted in the lock housing and the end of which is provided with a flange (8); and a means for locking the peg (3) in the lock housing in the longitudinal direction thereof. In order that the peg could not move in the sideward direction thereof with respect to the lock housing, prior devices comprise a second flange attached to the peg adjacent to an inlet (9) of the lock housing. This second flange can be omitted, if the inner surface of the lock housing (2) is cup-shaped and the diameter thereof corresponds to the diameter of the flange (8) of the peg.

2 Claims, 2 Drawing Sheets

Figure 1:
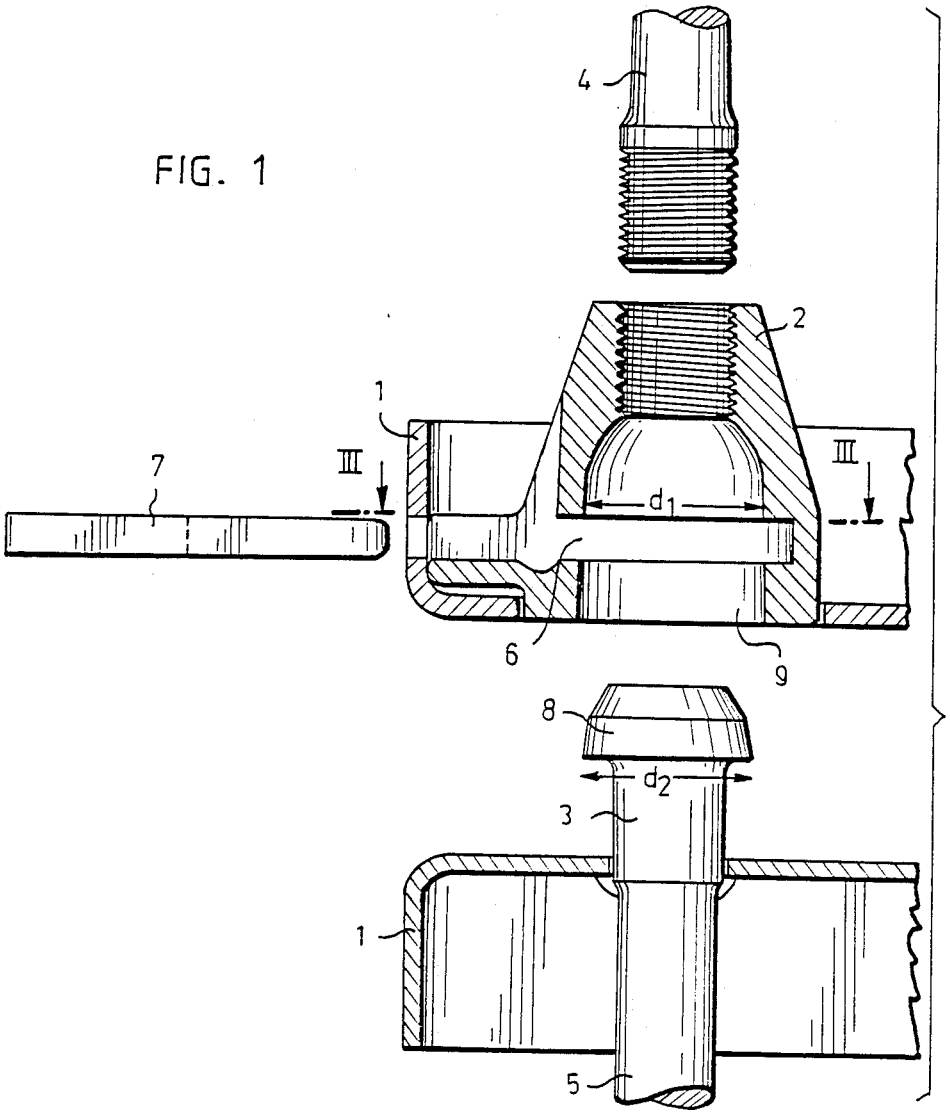

FIG. 3
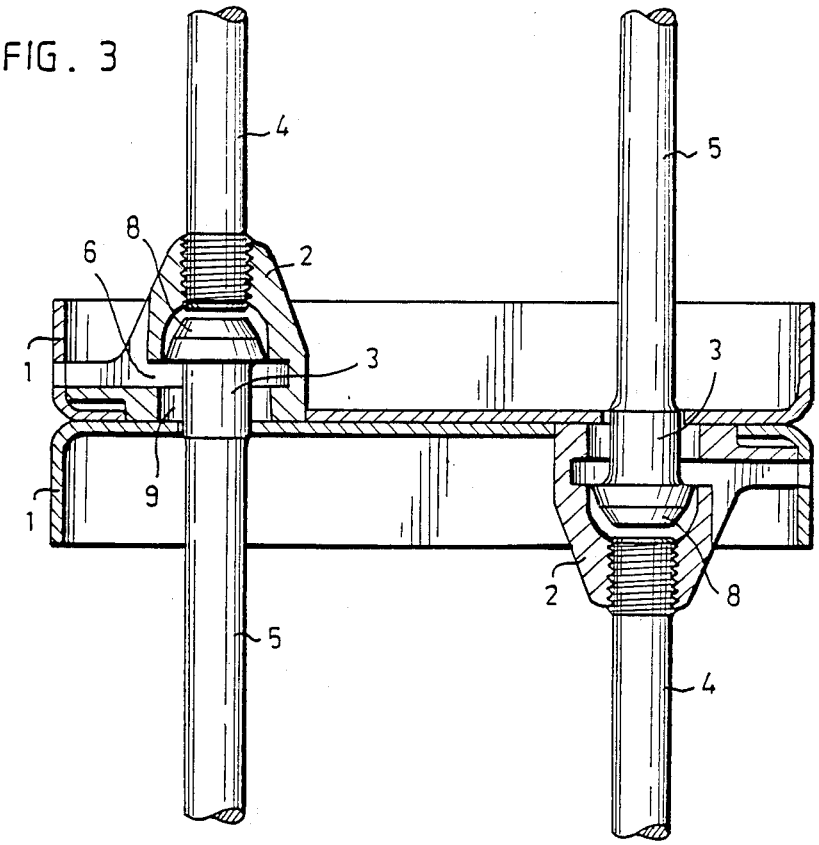
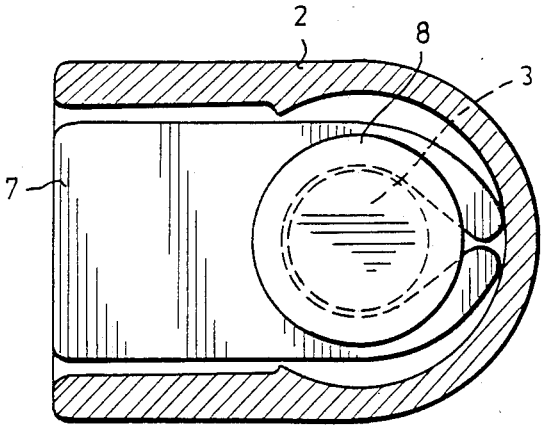
FIG. 2

DEVICE FOR JOINING TOGETHER BUILDING UNITS

The present invention relates to a device for joining together building units, comprising a lock housing positioned in one building unit; a peg projecting from the other building unit and arranged to be inserted into the lock housing in the joined position of the units, the free end of the peg being provided with a flange having a diameter substantially corresponding to the greatest diameter of the cup-shaped inner space of the lock housing; and a locking means arranged to be passed into an opening of the lock housing for locking the peg in the housing in the direction of the longitudinal axis thereof.

Finnish Patent Specification Nos. 57 293 and 58 669 disclose an extension joint for concrete piles in which the piles are fastened to each other by means of pegs provided on the joint faces and arranged to be inserted into lock housings so as to be locked therein. The pegs are locked in the lock housings in the direction of the longitudinal axis of the pegs by means of locking means cooperating with a flange provided at the end of the pegs.

In order that a peg provided with a flange could be inserted into the lock housing, the diameter of the inlet of the housing has to be at least equal to the diameter of the flange. In order to prevent a sideward displacement of the peg in the lock housing during the mounting, another ring-shaped flange is attached to the peg by welding so as to be positioned at a distance from the first-mentioned flange positioned at the end of the peg, whereby the diameter of this other flange corresponds to that of the inlet of the lock housing. The locking means surrounds the peg between the flanges.

A drawback of this known device is the complicated structure of the peg and the high costs of manufacture caused by the assembly of a plurality of parts.

Finnish Patent Specification No. 59 839 discloses an extension joint for concrete piles in which pegs projecting from the end of the piles are arranged to be inserted into lock housings. The pegs are provided with a transverse through hole for a rod-shaped locking means. The pegs disclosed in the patent have to be manufactured as separate bodies and they have to be attached to the pile e.g. by welding. The manufacture thereof further requires several stages, so that the total costs of the joint means are high.

The object of the present invention is to provide a device which enables the use of a peg simpler in structure and easier to manufacture than previously. The device according to the invention is characterized in that the flange of the peg is so dimensioned in the longitudinal direction of the peg that it can be entirely fitted in a space defined by the bottom of the inner space of the lock housing and the opening for the locking means.

By shaping the lock housing so that the inner surface thereof makes contact with the edge of the flange of the peg when the peg has been entirely inserted into the lock housing, an advantage is obtained in that the peg can be guided in the sideward direction, too, by means of the flange positioned at the end of the peg, by virtue of which no flange or peg part has to be provided in the peg adjacent to the inlet of the lock housing. This, of course, makes the peg more simple in structure. In addition, the peg according to the invention can be in a simple way formed of the end of a concrete steel by jolting, for instance.

If required, the device may be shaped in such a way that the diameters of the flange and the lock housing are substantially equal in a plane positioned between the end faces of the flange when the peg is in the locking position.

In the following a preferred embodiment of the invention will be described in more detail with reference to the attached drawings, wherein FIG. 1 shows a device according to the invention in a section perpendicular to the faces to be jointed, FIG. 2 is a horizontal sectional view of a lock housing along the line III . . . III of FIG. 1, and FIG. 3 illustrates the device when applied to a concrete pile.

FIG. 1 shows a joint between two building units. The joint faces of the building units are provided with steel plates 1 to which e.g. two lock housings 2 and two pegs 3 are attached. The lock housings and the pegs are positioned at the ends of piles in such a way that when the piles are positioned one after another, the pegs are inserted into the lock housings as shown in FIG. 1. Concrete steels 4 are fastened in the lock housings 2, and the pegs 3 are formed by concrete steels 5 projecting outside the steel plate.

An opening 6 is provided in the side wall of the lock housings, through which opening a two-branch locking means 7 can be knocked into the lock housing so that the branches surround the peg 3.

The free end of the peg is provided with a ring flange 8 which is preferably integral with the peg 3 and formed by jolting the end of the concrete steel 5. The function of the flange 8 is to lock the peg in the longitudinal direction thereof in the lock housing by means of the locking means 7. In order that the peg could be inserted into the lock housing 2, the diameter of an inlet 9 of the lock housing is at least equal to the diameter of the flange 8.

The inner surface of the lock housing is cup-shaped and the diameter $d_1$ thereof corresponds substantially to the diameter $d_2$ of the flange 8 of the peg. By dimensioning the lock housing 2 and the flange 8 in such a way that the flange is not able to move in a direction perpendicular to the longitudinal axis of the peg when it is in the lock housing, the building units are aligned with respect to each other without any other flange positioned adjacent to the inlet 9 of the lock housing.

According to the invention the height of the flange 8 of the peg in the longitudinal direction of the peg is such that the peg can be entirely fitted in a space defined between the bottom of the inner space of the lock housing, i.e. the end of the concrete steel 4 and the opening 6. Therefore the peg 3 is simple in structure and easy to manufacture. In spite of the small height thereof, the peg is not able to move in tee sideward direction with respect to the lock housing, because the diameter of the inner space of the lock housing corresponds to the diameter of the flange.

In the embodiment shown in the figures the flange 8 and the lock housing 2 make contact with each other on the periphery of the flange remote from the free end of the peg, because the diameter of the flange decreases towards the free end of the peg and the inner surface of the lock housing is substantially cylindrical at this point. The inner surface of the lock housing can alternatively be so shaped that the diameter of the housing increases continuously towards the groove of the locking means, whereby the contact line between the lock housing and the flange can be positioned between the end faces of the flange.

The building units are joined to each other by placing the units one upon the other and knocking the joint means 7 in place into the lock housings, so that the branches are positioned around the peg 3 as shown in FIG. 3. The device according to the invention is particularly suited for joining concrete piles, which is shown in FIG. 3.

I claim:

1. A device for joining together building units, comprising a lock housing positioned in a first building unit, the lock housing having an upper end portion, a lower end portion, a sidewall connecting the upper and lower end portions, a longitudinal inlet opening in the lower end portion, a lateral opening in the side wall and positioned above the inlet opening, and a cup-shaped inner space inside the upper end portion extending upwardly from the lateral opening to a bottom portion of the cup-shaped inner space; a peg having a free end projecting from a second building unit and arranged to be inserted into the lock housing in the joined position of the units, the free end of the peg being provided with a flange having a diameter substantially corresponding to the greatest diameter of the cup-shaped inner space of the lock housing; and a branched locking means arranged to be passed through the lateral opening of the lock housing so that the branches thereof surround the peg adjacent the flange to lock the peg in the housing in the direction of the longitudinal axis thereof, the flange being dimensioned in the longitudinal direction of the peg so that it can be entirely fitted in a space defined by the bottom of the cup-shaped inner space of the lock housing and the lateral opening for the locking means.

2. A device according to claim 1, wherein the diameter of the flange and the diameter of the cup-shaped inner space of the lock housing are substantially equal in a plane positioned between the end faces of the flange when the peg is in the locking position.

* * * * *